US005273248A

United States Patent [19]

Grander

[11] Patent Number: 5,273,248

[45] Date of Patent: Dec. 28, 1993

[54] CONVERTIBLE EASEL AND BED

[76] Inventor: Catherine V. Grander, 804 W. James, Austin, Tex. 78704

[21] Appl. No.: 973,297

[22] Filed: Nov. 9, 1992

[51] Int. Cl.[5] ..... A47B 97/04

[52] U.S. Cl. ..... 248/460; 5/111; 211/2

[58] Field of Search ..... 248/460, 464, 463, 447, 248/155, 155.4; 5/110, 111, 3, 4; 211/2, 132, 130

[56] References Cited

U.S. PATENT DOCUMENTS

| | | | |
|---|---|---|---|
| D. 118,982 | 2/1940 | Mash et al. . | |
| 937,671 | 10/1909 | Borgzinner | 248/463 |
| 981,177 | 1/1911 | Deem | 248/460 |
| 1,899,567 | 2/1933 | Haug | 211/130 X |
| 2,485,517 | 10/1949 | Vaule et al. | 248/464 |
| 2,642,588 | 6/1953 | Gunn | 5/308 |
| 2,933,737 | 4/1960 | Schiffmann | 5/308 |
| 3,467,259 | 9/1969 | Silver | 268/460 |
| 4,707,871 | 11/1987 | Pocanschi | 5/4 X |
| 4,795,162 | 1/1989 | Rhetts | 248/460 X |
| 4,882,796 | 11/1989 | McNeal et al. | 5/8 |
| 4,971,284 | 11/1990 | Curry | 248/460 |

*Primary Examiner*—Alvin C. Chin-Shue
*Assistant Examiner*—Korie H. Chan
*Attorney, Agent, or Firm*—Timmons & Kelly

[57] ABSTRACT

A pair of boards are hinged together to form a double sided easel. The boards can be moved to a coplanar position to form a child's bed. The easel has a pair of easel trays that become legs for the bed. Side boards on the outer sides of the boards become side rails on the bed. End boards on the boards support the easel on a supporting surface and become a head board and a foot board for the bed.

7 Claims, 2 Drawing Sheets

CONVERTIBLE EASEL AND BED

BACKGROUND OF THE INVENTION

1. Field of the Invention

This invention relates in general to furniture. In particular, the invention relates to an easel that can be converted into a bed for children.

2. Description of related art including information disclosed under 37 C.F.R. §§ 1.97–1.99

Schools, day care centers, and homes with small children often have small beds or cots on which children can sleep. Young children often need to take naps in the afternoon, and small beds or cots keep the sleeping children off of the floor.

Small children are often taught arts and crafts, such as painting, using easels to hold the art materials. Easels sometimes consist of a pair of boards, hinged together at the top, so that each board can serve as an easel for a child.

Floor space is often a scarce resource at schools, day care centers, and homes. When furniture and other items are not in use, they must be stored or at least moved out of the way of other activities.

If a piece of furniture can be used for more than one activity, there will be a savings of both money and storage space. For example, if an easel can be converted into a bed, there will be no need to buy a bed in addition to the easel. Also, the easel would be used during nap time, rather than stored. The storage space required for easels and beds will be reduced substantially in half.

SUMMARY OF THE INVENTION

The general object of the invention is to provide an easel that can be easily converted into a bed. This object is accomplished by a convertible easel and bed having a pair of boards hinged together, and being movable between a folded position and a coplanar position. A pair of easel trays are attached to the boards, and become legs to support the boards when the boards are in the coplanar position.

The easel may also have a pad on the inner sides of the boards, when the device is in the coplanar position. The pad makes the bed more comfortable.

The easel may also have four side boards, each side board extending along one side of the inner sides of the boards. These side boards become the sides of the bed, and help to keep the child from rolling out of the bed.

The easel may also have a pair of end boards, each end board being attached to the lower end of one of the boards when the boards are in the folded position. The end boards thus support the easel on a supporting surface. When the device is in the coplanar position, the end boards become the head and foot of the bed.

The above, as well as additional objects, features, and advantages of the invention will become apparent in the following detailed description.

DESCRIPTION OF THE PREFERRED EMBODIMENT

Figure 1:
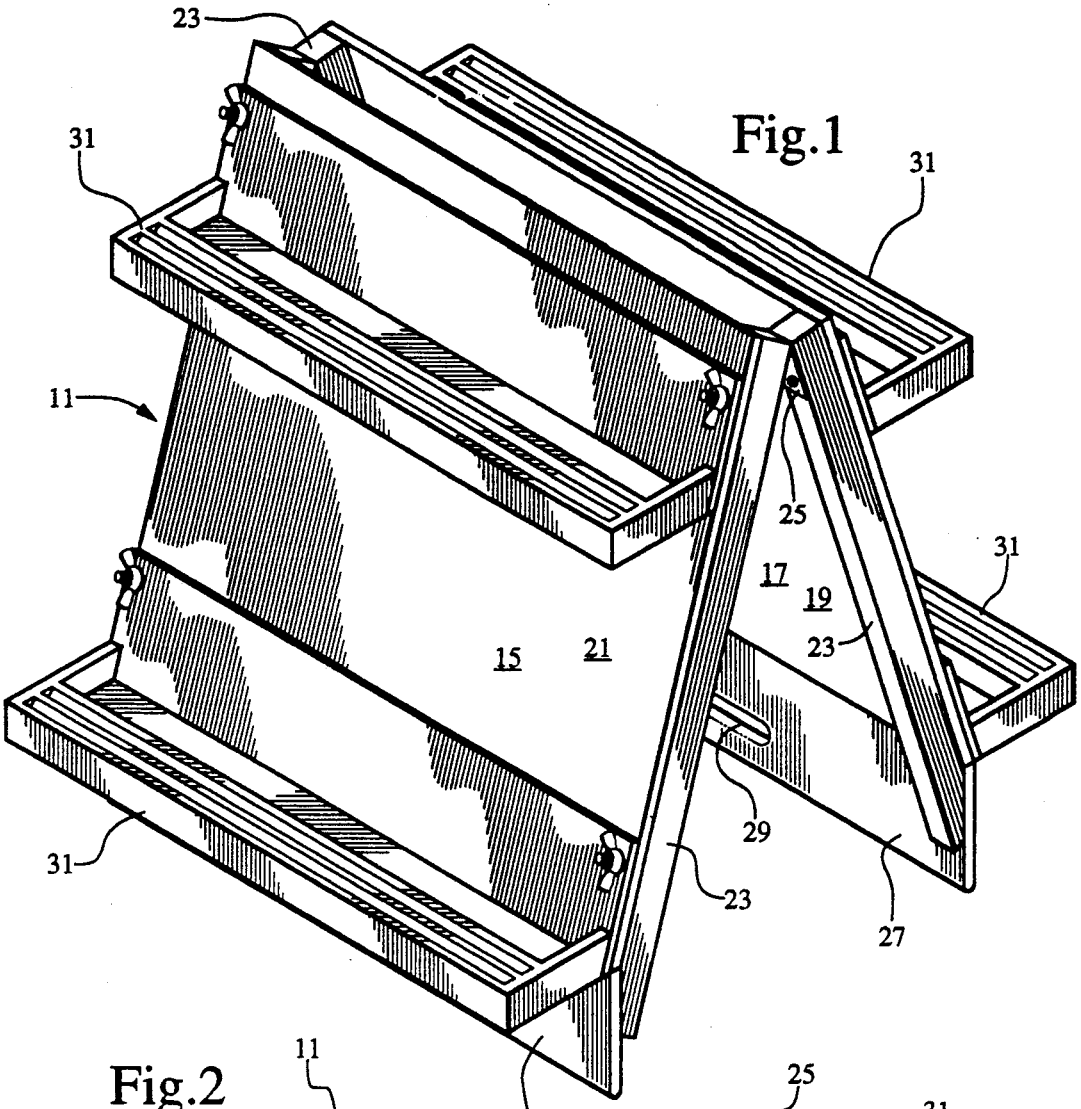
FIG. 1 is a perspective view of the convertible easel and bed of the invention, in the folded, or easel, configuration.
Figure 2:
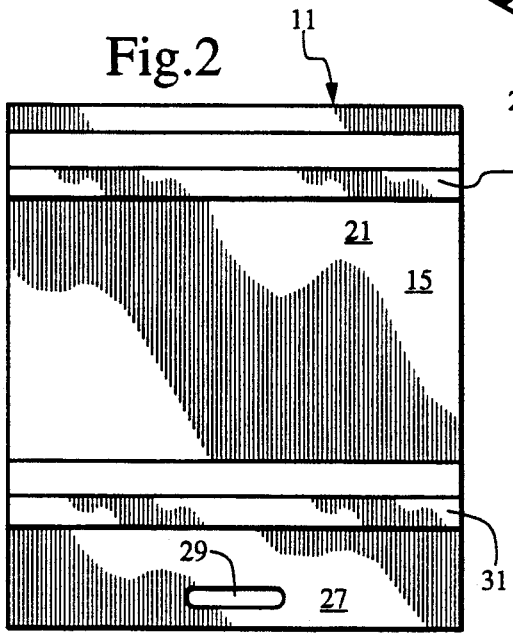
FIG. 2 is a front elevation of the easel of FIG. 1.
Figure 3:
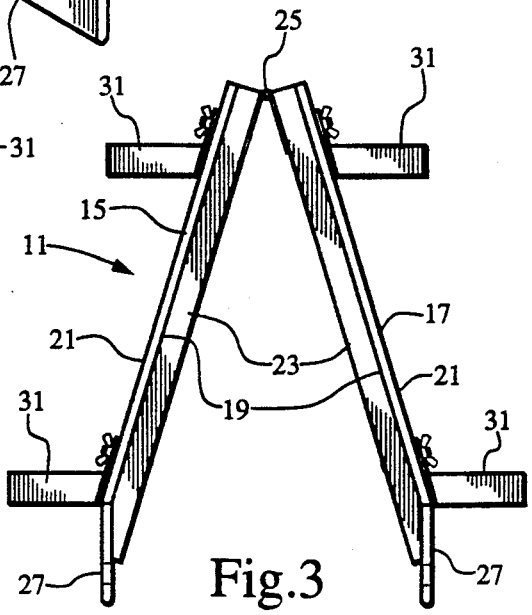
FIG. 3 is a side elevation of the easel of FIG. 1.
Figure 4:
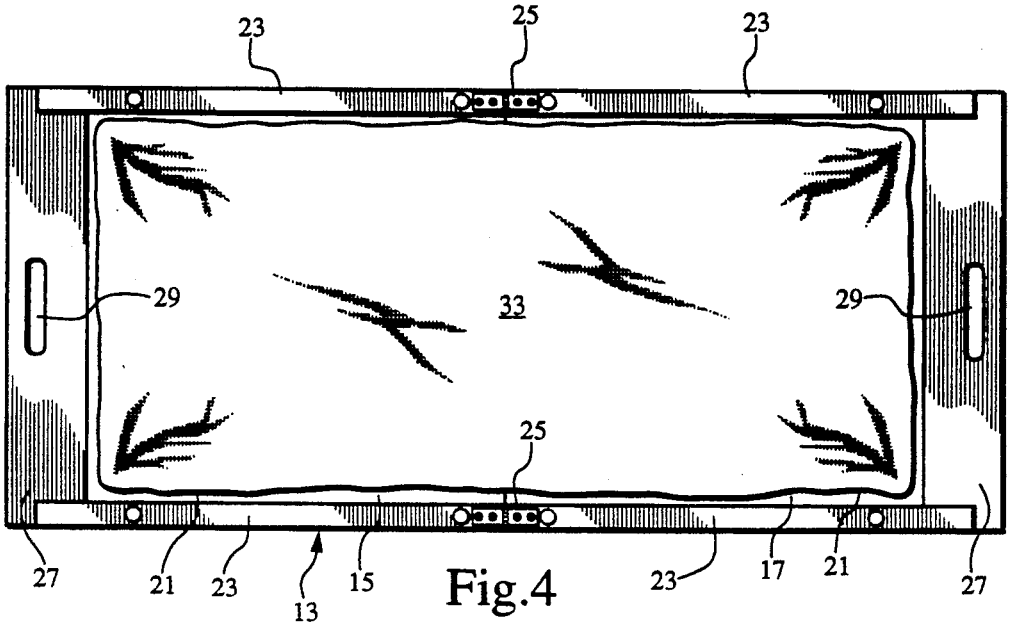
FIG. 4 is a top plan view of the convertible easel and bed of the invention, in the coplanar, or bed configuration.
Figure 5:
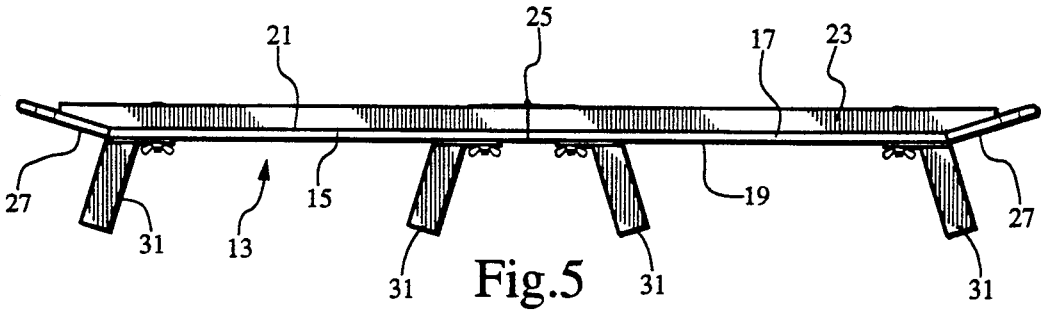
FIG. 5 is a side elevation of the bed of FIG. 4.

The preferred embodiment of the invention is an apparatus that converts between an easel 11, shown in FIGS. 1–3, and a bed 13, shown in FIGS. 4 and 5. The easel 11 has two boards 15 and 17, each of which is approximately two feet (61.0 cm.) square, and is preferably one half inch (1.27 cm.) thick plywood. Each board 15 and 17 has an inner side 19 and an outer side 21. The outer side 21 of each board 15 and 17 provides an area for use as an easel 11 for art projects. The inner sides 19 of the boards 15 and 17 provide a bed surface on which a child can lie.

A side board 23 extends along the each side of the inner side 21 of each board 15 and 17. Each side board 23 is approximately one and one half inch (3.81 cm.) square and about two feet (61.0 cm.) long. The side boards 23 are hinged together with a pair of hinges 25, to allow the boards 15 and 17 to be moved between a folded position, shown in FIGS. 1–3, and a coplanar position, shown in FIGS. 4 and 5.

When the boards 15 and 17 are in the folded position, the side boards 23 add strength and stability to the easel 11. When the boards 15 and 17 are in the coplanar position, the side boards 23 act as side rails for the bed 13.

An end board 27 is attached to the lower end of each board 15 and 17. Each end board 27 is about two feet (61.0 cm. ) wide, about five inches (12.7 cm.) tall, and about one half inch (1.27 cm.) thick. The end boards 27 support the easel 11 on a supporting surface, and serve as a head board and a foot board for the bed 13. Each end board 27 may have an opening 29 that serves as a handle to facilitate handling of the easel 11. The end boards 27 are attached to the boards 15 and 17 and to the side boards 23 at an angle of about 17 degrees, so that when the boards 15 and 17 are in the folded position, the end boards 27 are vertical.

A pair of easel trays 31 are attached to the outer side 21 of each board 15 and 17. Each easel tray 31 extends horizontally outward from the board 15 and 17 to which it is attached, when the boards 15 and 17 are in the folded position. The easel trays 31 provide a convenient holder for art supplies.

When the boards 15 and 17 are in the coplanar position, the easel trays 31 become legs for the bed 13, as seen in FIG. 5. The easel trays 31 hold the boards 15 and 17 about four inches (10.2 cm.) off of the supporting surface.

The bed 13 may also have a sleeping pad 33, as shown in FIG. 4, to make the bed 13 more comfortable. The pad 33 may be removable, or it may be a pair of pads permanently attached to the outer sides 21 of the boards 15 and 17.

For storage purposes, the boards 15 and 17 may be moved to a completely folded position, in which the side boards 23 abut, and the boards 15 and 17 are parallel. The openings 29 are thus close together to form a convenient handle, so the easel 11 can be easily carried.

The combination easel 11 and bed 13 of the invention has several advantages over the prior art. The combination eliminates the necessity of buying and storing both easels and beds. Further, the easel 11 can be easily carried and unfolded by a child. The combination provides both a double-sided easel 11 and a bed 13 for a child.

The invention has been described in only one embodiment. It should be apparent to those skilled in the art that the invention is not so limited, but is susceptible to various changes and modifications without departing from the spirit of the invention.

I claim:

1. A convertible easel and bed, comprising:

a pair of boards, having parallel inner and outer sides, the boards being hinged together, wherein the outer sides of the boards form a double sided easel when the two boards are in a folded position, and the inner sides of the boards form a flat surface for supporting a prone person when the two boards are unfolded to a coplanar position;

a pad on the inner sides of the boards which substantially covers the flat surface defined by the inner sides when the boards are in the coplanar position; and a pair of easel trays, each tray being attached to the outer side of one of the boards, wherein the trays become legs to support the boards when the boards are in the coplanar position.

2. A convertible easel and bed, as recited in claim 1, further comprising a second pair of easel trays, wherein each of the first pair of trays and each of the second pair of trays are attached to the outer side of one of the boards, and wherein the trays become legs to support the boards when the boards are in the coplanar position.

3. A convertible easel and bed, as recited in claim 1, wherein each easel tray extends across the width of the board to which it is attached.

4. A convertible easel and bed, as recited in claim 1, further comprising four side boards, each side board extending along one side of the inner sides of the boards.

5. A convertible easel and bed, as recited in claim 1, further comprising a pair of end boards, each end board being attached to the lower end of one of the boards when the boards are in the folded position, to support the easel on a supporting surface.

6. A convertible easel and bed, as recited in claim 5, further comprising a handle on one of the end boards to facilitate handling of the easel.

7. A convertible easel and bed, as recited in claim 6, wherein the handle is an opening through one of the end boards.

* * * * *